United States Patent [19]

Roccaforte

[11] 4,354,630

[45] Oct. 19, 1982

[54] PYRAMID CARTON CLOSURE

[75] Inventor: Harry I. Roccaforte, Western Springs, Ill.

[73] Assignee: Champion International Corporation, Stamford, Conn.

[21] Appl. No.: 195,875

[22] Filed: Oct. 10, 1980

[51] Int. Cl.[3] ..... B65D 5/10; B65D 5/36

[52] U.S. Cl. ..... 229/39 R; 229/15; 229/27; 229/41 R

[58] Field of Search ..... 229/27, 41 B, 39 R, 229/38, 15, 39 B, 41 C, 41 R, 41 D

[56] References Cited

U.S. PATENT DOCUMENTS 2,017,724 10/1935 Neumann ..... 229/39 R 2,983,421 5/1961 Turpin ..... 229/27

4,266,716 5/1981 Austin ..... 229/41 R

*Primary Examiner*—William Price

*Assistant Examiner*—Gary E. Elkins

*Attorney, Agent, or Firm*—Evelyn M. Sommer; John H. Mulholland

[57] ABSTRACT

An automatic lock bottom carton with a pyramid closure is disclosed having two tabs extending from two panels that lock into corresponding openings on tabs of oppositely presented panels. The double lock prevents the collapsing of the pyramidal shape so that it can support a product in its intended form. The carton can be of single cell or multiple cell structure with one of the pyramid sides derived from the center divider.

8 Claims, 14 Drawing Figures

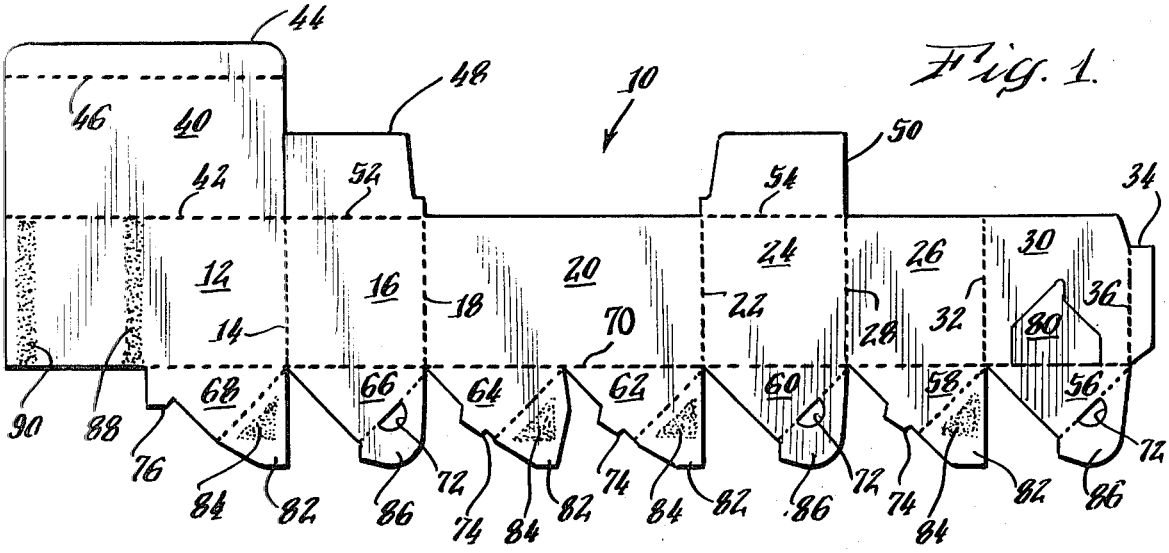
Fig. 1.
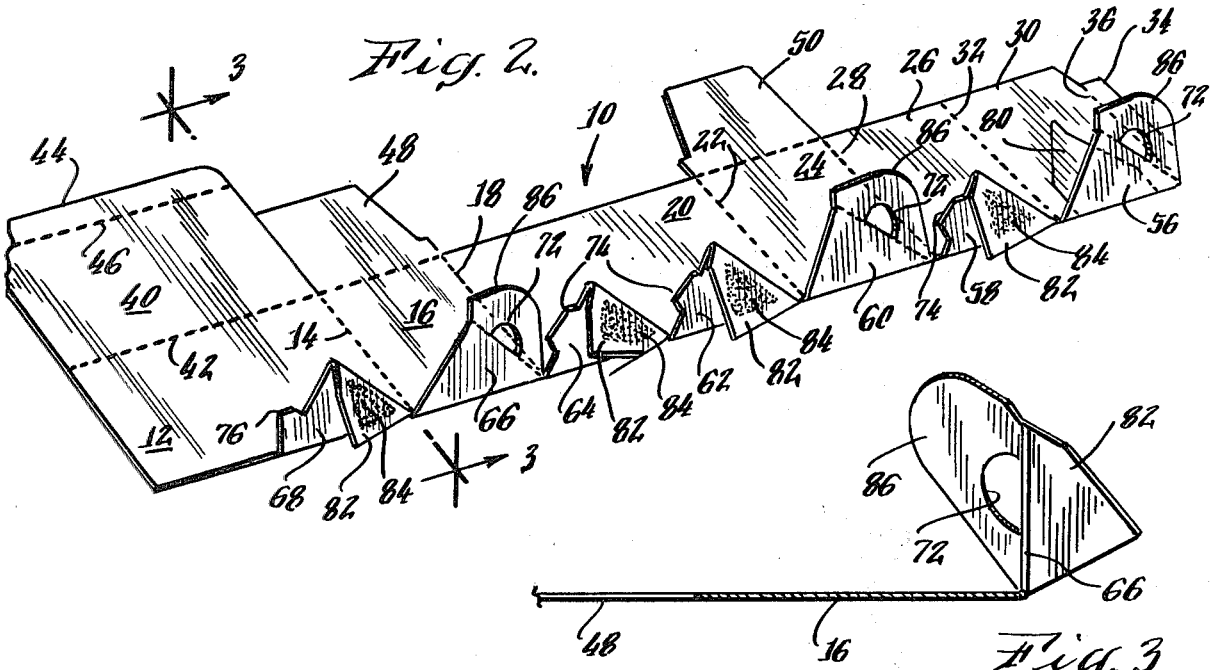
Fig. 2.
Fig. 3.
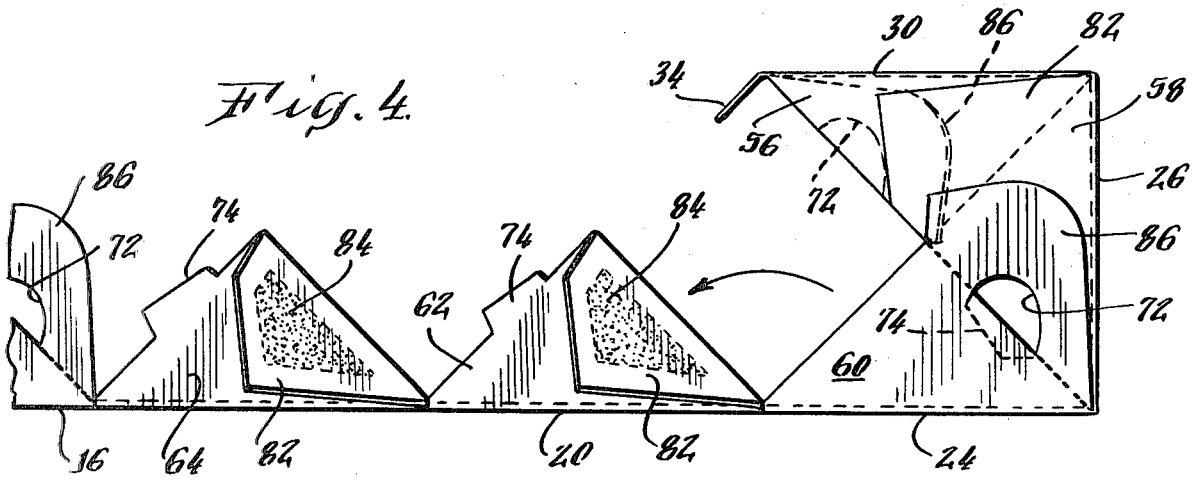
Fig. 4.

PYRAMID CARTON CLOSURE

BACKGROUND OF THE INVENTION

The subject invention relates to a new and improved automatic lock bottom carton with a pyramid closure having two tabs extending from two panels that lock into corresponding openings on tabs of oppositely presented panels. The carton is formed from a planar sheet of paperboard blank and includes an auto-erecting lock bottom which enables the carton to be shipped from the manufacturer in a flattened condition. The closure includes a double lock which prevents the collapsing of the pyramidal shape once erected so it can support a product and maintain it in its intended form. An example of such a product would be contoured nursing pads which when made from soft material must be packaged in a manner which will retain their concave-convex shape.

The carton of the invention can be of a single cell structure or a multiple cell structure with a pyramid closure in each cell and a center divider between the cells. In this type of carton one of the pyramid sides is derived from the center divider.

Various cartons in the prior art have been provided with a pyramid closure. It has been found, however, that the higher the vertex of the pyramid is from its base, the more positively it stays formed. When a vertex of a pyramid is low or shallow from its base the pyramid has a tendency to collapse to become flat and to lose its form, so that what is left is basically a flat standard automatic locked end. The present invention solves this problem by having two tabs from two panels locking into corresponding openings in two opposing panels, thus preventing the collapsing of the pyramidal shape and supporting the product in its intended form.

SUMMARY OF THE INVENTION

The invention is an automatic lock bottom carton having a pyramid closure with a minimum problem of collapsing. The carton of the invention includes a generally tubular side wall with alternately hingedly connected opposed side panels and end panels.

In the case of a double celled carton of the invention, a side panel liner panel and a center divider panel are hingedly attached to a side panel at an end thereof opposite an adjacent connected end panel or are hingedly attached to an end panel at its end opposite an adjacent side panel. The center divider panel is provided with a glue flap for engagement of the side panel opposite the side panel liner panel to which it is attached. A plurality of generally triangular bottom panels are hingedly connected to the bottom edges of the side wall, the side panel liner and the center divider panel. A top panel is hingedly connected along the bottom edge thereof to the top edge of one of the side panels. A pair of top closure flaps each are hingedly connected along the bottom edge thereof to the top edge of an associated end panel. The plurality of bottom panels each have a tab. The tabs of the bottom panels connected to the end panels and the center divider panel have central openings to receive the projecting lock tabs of the bottom panels connected to the side panels and the side liner panel. A glue flap for connecting one of the end panels to an adjacent side panel is also provided.

In order to complete one of the pyramids in the double celled container, a cutout portion is hingedly connected to the center divider to make up one side of one of the pyramids. The triangular bottom panels make up the rest of the pyramid sides. The bottom panels with projecting tabs also have second tabs of generally triangular shape which are folded back upon themselves in a manner which permits their adhesive connection to adjacent bottom panels and to the cutout panel of the center divider.

In the case of a single cell carton, the single pyramid is made from the four generally triangular bottom panels which are hingedly connected to the bottom edges of each of the side and end panels of the side wall. The bottom panels of the single cell carton each have a tab and the tabs of the bottom panels connected to a first opposed pair of panels have central openings to receive the tabs of the second alternately opposed pair of bottom panels. The triangular bottom panels having the projecting lock tabs also have second tabs attached thereto for folding back into adhesive engagement with adjacent triangular bottom panels to complete the pyramid closure.

Thus, it will be seen that the double lock of the structure prevents a collapsing of the pyramidal shape so it can support a product in its intended form.

BRIEF DESCRIPTION OF THE DRAWINGS

FIG. 1 is a plan view of the paperboard blank adapted to be folded into a two cell automatic lock bottom carton having a pyramid closure;

FIG. 2 is a perspective view of the new and improved carton of the subject invention illustrating the triangular bottom panels in folded up condition with triangular bottom panels and tabs in folded condition;

FIG. 3 is a cross sectional view taken along line 3—3 of FIG. 2;

FIG. 4 is a bottom view of the carton of FIGS. 1 through 3 in partially erected condition;

DESCRIPTION OF THE PREFERRED EMBODIMENT

Figure 5:
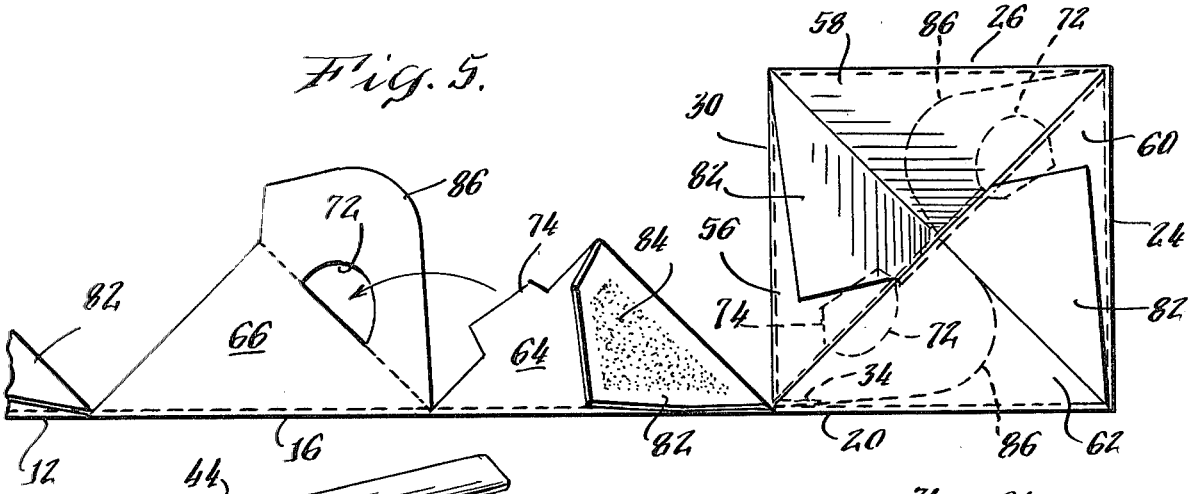
FIG. 5 is a view similar to FIG. 4 at a subsequent stage of the erection of the carton.
Figure 8:
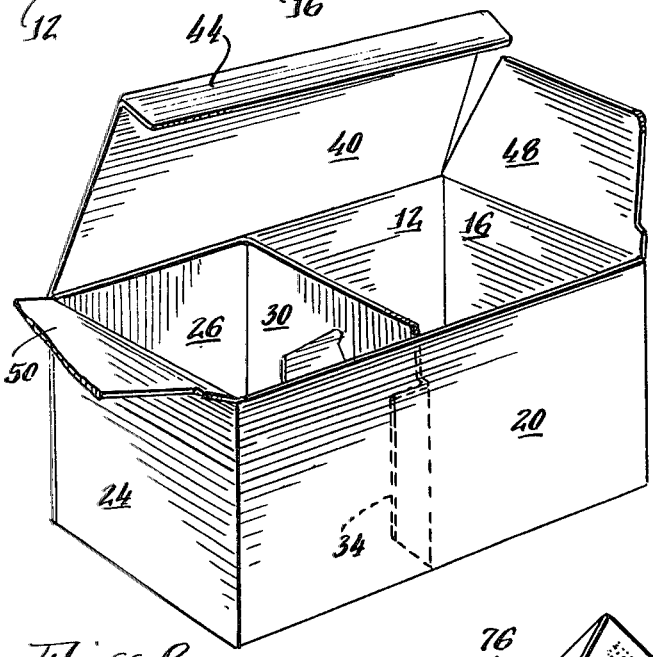
FIG. 8 is the perspective view of the fully erected carton.
Figure 6:
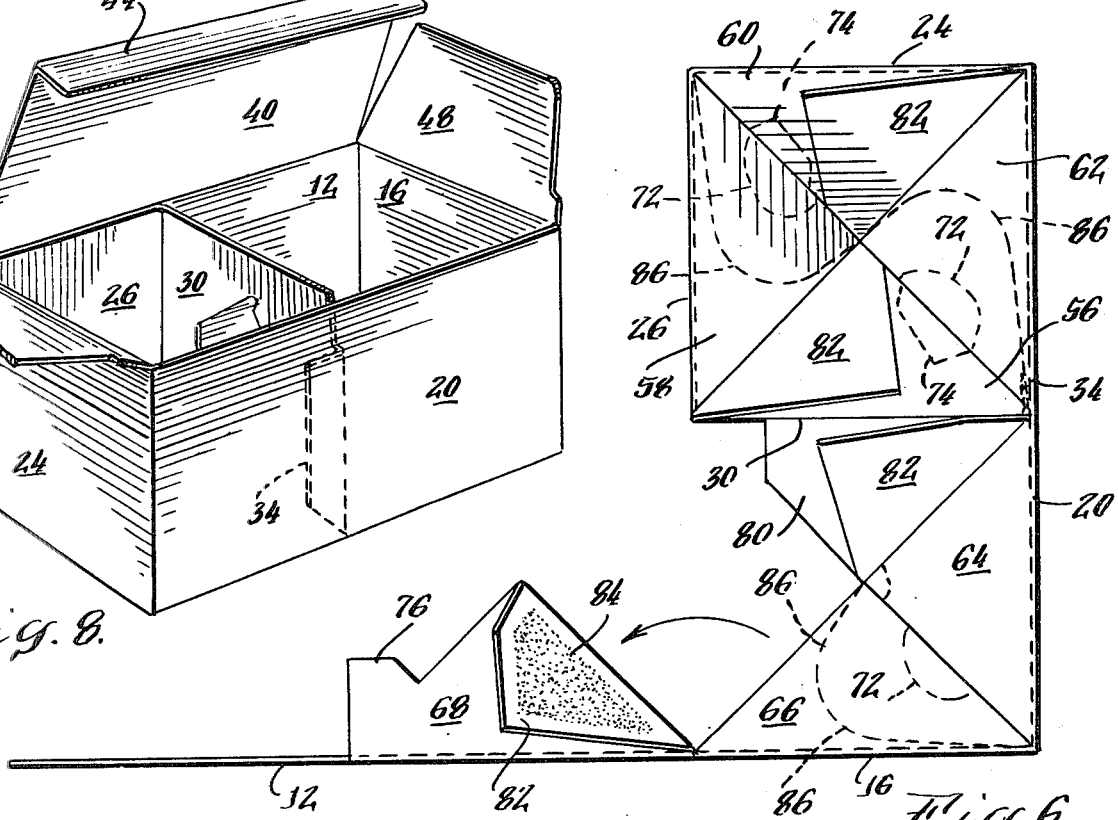
FIG. 6 is a view similar to FIGS. 4 and 5 at a still later stage of erection of the carton.
Figure 7:
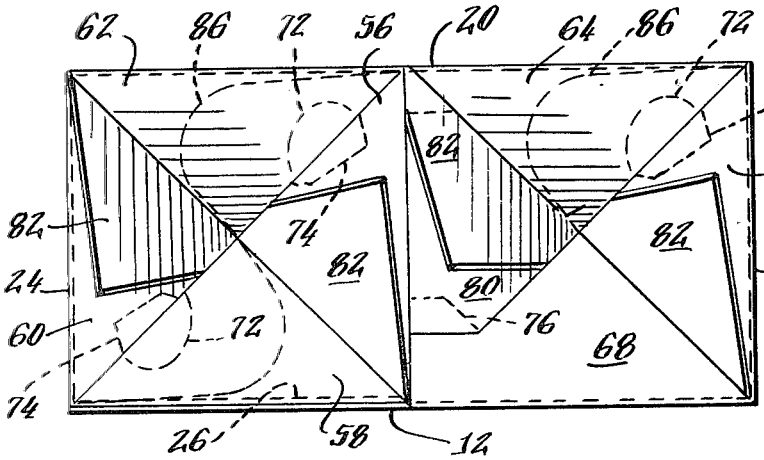
FIG. 7 is a plan view of the fully erected carton.
Figure 9:
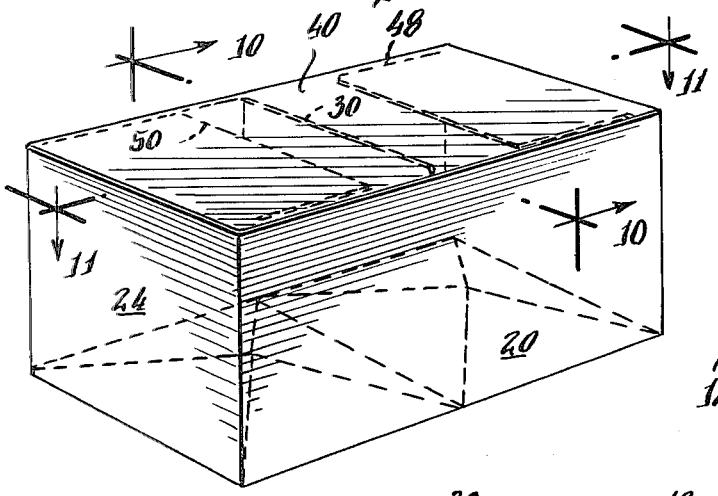
FIG. 9 is a schematic perspective view of the carton.
Figure 10:
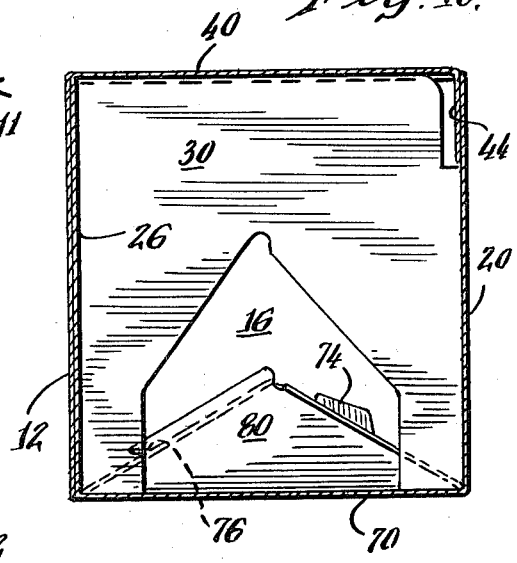
FIG. 10 is a cross sectional view taken along line 10—10 of FIG. 9.
Figure 11:
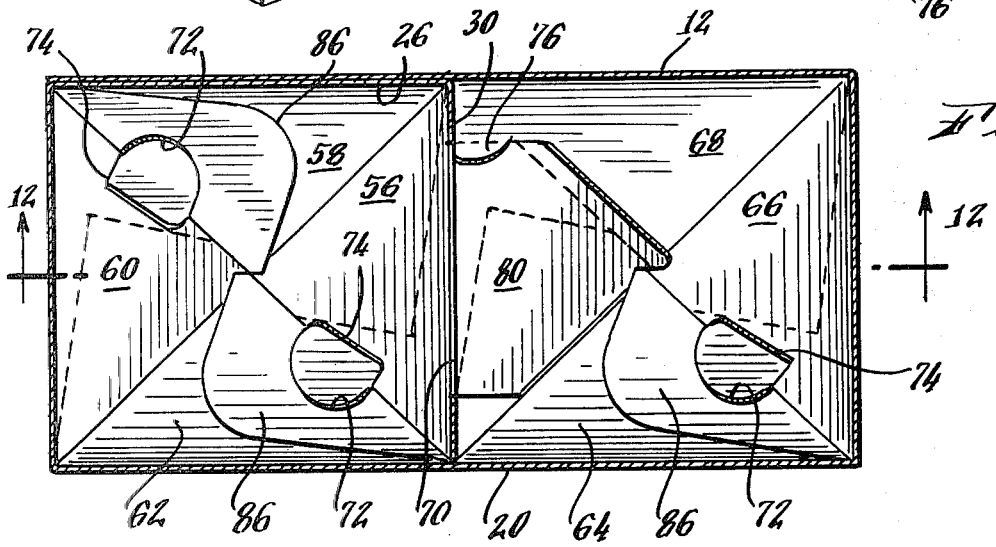
FIG. 11 is a cross sectional view taken along line 11—11 of FIG. 9, looking down into the carton.
Figure 12:
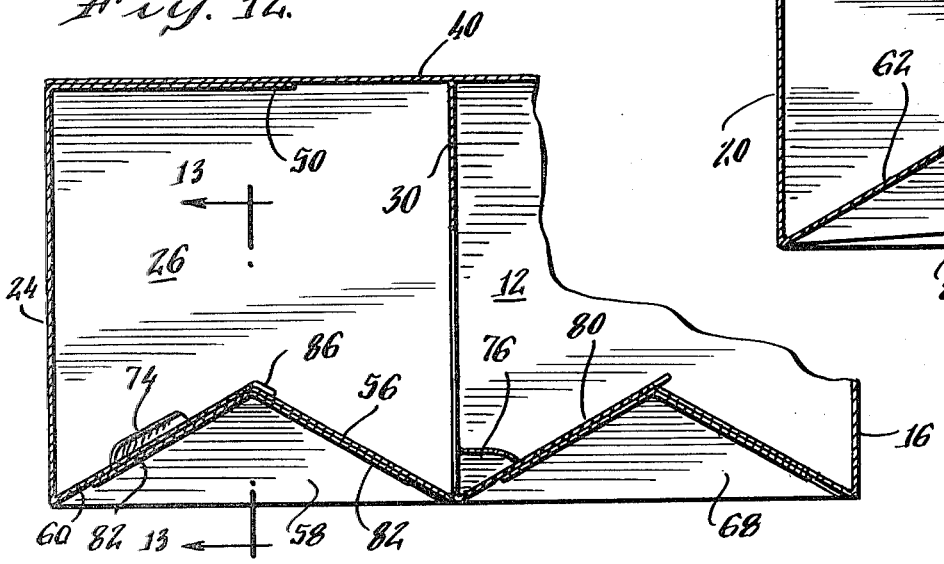
FIG. 12 is a cross sectional view taken along line 12—12 of FIG. 11, with a portion broken away.
Figure 13:
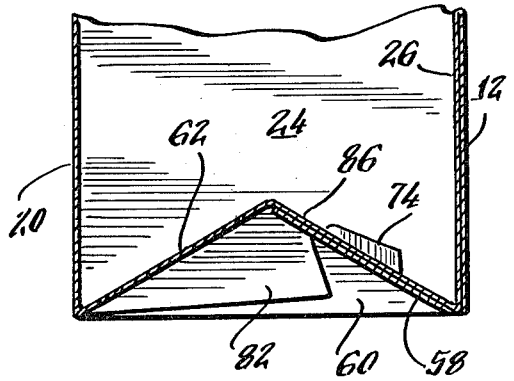
FIG. 13 is a cross sectional view taken along line 13—13 of FIG. 12.

The numeral 10 generally designates the planar paperboard blank used in making the automatic lock bottom carton having a pyramid closure and two cells. The blank 10 has a side panel 12 and hingedly connected thereto by means of common fold line 14 an end panel 16. Hingedly connected to end panel 16 by means of fold line 18 is a side panel 20 which, when the carton is erected will oppose the side panel 12. Hingedly connected to the side panel 20 by means of common fold line 22 is end panel 24 which, when the carton is erected will oppose end panel 16.

A side panel liner panel 26 is hingedly connected to end panel 24 by means of a common fold line 28. On the side of the side panel liner panel 26 opposite the end panel 24 is a center divider panel 30 hingedly connected by means of a common fold line 32. The center divider panel 30 has a glue flap 34 hingedly connected to its free end by common fold line 36.

A top panel 40 is hingedly connected at the lower edge thereof by means of common fold line 42 to the side panel 12. At the top of the top panel 40 a closure flap 44 is hingedly connected by common fold line 46 to the top panel 40. The top panel 40 and the flap 44 act as the top closure for the two celled carton in cooperation with closure flaps 48 and 50. Closure flap 48 is connected to the top of end panel 16 by means of common fold line 52 and closure flap 50 is connected to the top of end panel 24 by means of common fold line 54.

On the bottom of the center divider panel 30 is a triangular bottom panel 56. Adjacent to triangular bottom 56 and connected to side panel liner panel 26 is a triangular bottom panel 58. In like manner, a triangular bottom panel 60 is associated with end panel 24. Side panel 20 has two triangular bottom panels 62 and 64 hingedly connected at its lower edge 70 and end panel 16 has an associated triangular bottom panel 66. The side panel 12 has a triangular bottom panel 68 attached to the lower edge thereof. All of the triangular bottom panels are hingedly connected by means of common fold line 70 to their respectively associated panel.

The triangular bottom panels 56, 60 and 66 all have tabs with central openings 72 extending therefrom. The triangular bottom panels 58, 62 and 64 all have a projecting lock tab 74 for receipt in an opening 72 with the inner periphery thereof enclosing the lock tab 74. The triangular bottom panel 68 has a specially spaced tab 76 for engagement with a special cutout 80 in the center divider panel 30 which completes one side of one of the pyramid closures. Each of the triangular bottom panels with projecting tabs 74, namely, bottom panels 58, 62 and 64, as well as bottom panel 68 have second tabs 82. The tabs 82 have adhesive areas 84 which adhesively secure their associated panel to an adjacent triangular bottom panel. When the carton is fully erected the openings 72 of the triangular bottom panels 56, 60 and 66 are defined by tabs 86 which fold inwardly such that the bottom panels 56, 60 and 66 to which they are attached are adhesively secured to adjacent triangular bottom panels by folded back tabs 82.

FIG. 4 illustrates the first step of assembly of the carton showing the right end of the blank of FIG. 1. The sequence of the carton folding operation is described as follows. The fold about common fold line 70 is made first and then the back folds of the tabs on the triangular bottom panels 58, 62, 64, and 68 are made. Next, adhesive is applied in the areas 84 and on panel 12 in areas 88 and 90. The carton is then folded about fold line 32. The next or third fold is made about fold line 22 and this brings glue flap 34 into engagement with side panels 20 intermediate the ends thereof. The fourth fold brings side panel 12 around in opposing relationship to side panel 20 and completes the side wall. The carton is then assembled in flat condition for shipment to the customer who upon erecting the carton so as to bring the panels 12 and 20 in parallel register, automatically locks the tabs 74 into their associated openings 72 in folded back tabs 86 to form the completed automatic lock bottom carton with a two celled pyramid closure.

Figure 14:
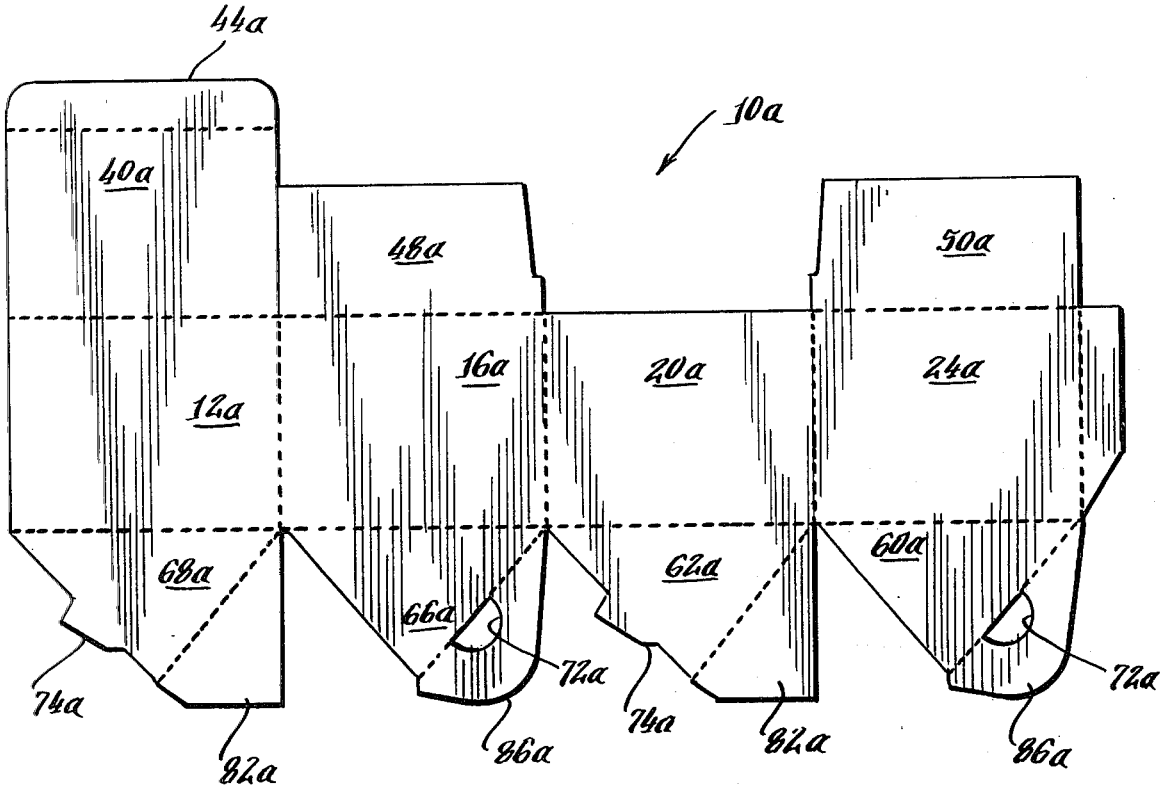
FIG. 14 is a plan view of a blank for erection of a single cell carton having the automatic lock bottom and pyramid closure of the invention.

FIG. 14 illustrates a blank which is erected in the same manner as the described embodiment of FIGS. 1 to 13 but which is a single cell automatic lock bottom carton with a pyramid closure. Like parts of FIG. 14 are given numerals corresponding to those of FIGS. 1–13 with the subscript "a" added. The single cell carton, of course, contains no center divide 30 and therefore is much simpler to construct. It does, however, have the advantage that is present in the more complex embodiment of FIGS. 1 to 13 of providing an automatic lock bottom carton with a substantially non-collapsible pyramid closure having two tabs extending from two panels that lock into corresponding opening on tabs of oppositely presented panels. Accordingly, a double lock is provided which prevents the collapsing of the pyramidal shape so that it can support a product in its intended form.

The embodiments described are for purely illustrative purposes and various modifications in the details shown and described may be made without departing from the scope or spirit of the invention as defined by the appended claims. For example, other top closure arrangements can be utilized or a single cell or double cell carton can be used as a liner for other outside wrappers or cartons.

What is claimed is:

1. A paperboard blank adapted to be folded into an automatic lock bottom carton having a pyramid closure comprising:

a first side panel;

a generally triangular bottom panel hingedly connected to said first side panel;

a first end panel hingedly connected to said first side panel;

a generally triangular bottom panel hingedly connected to said first side panel;

a second side panel hingedly connected to said first end panel;

a generally triangular bottom panel hingedly connected to said second side panel;

a second end panel hingedly connected to said second side panel;

a generally triangular bottom panel hingedly connected to said second end panel;

a projecting lock tab on each of a pair of opposing triangular bottom panels;

a tab with a central opening on each of the triangular botton panels adjacent said triangular bottom panels with said projecting lock tabs; and a glue flap panel for hingedly connecting one of said end panels to an adjacent side panel of the carton.

2. The blank of claim 1 in which the generally triangular bottom panels with the projecting tabs have second tabs which can be folded back for adhesive engagement with adjacent triangular bottom panels.

3. The blank of claim 1 in which said side panels have more than one triangular bottom panel hingedly connected thereto.

4. The blank of claim 1 or 2 in which a side liner panel is hingedly connected to an end panel on its side opposite its hinged connection wit a side panel and a center divider panel is hingedly connected to said side liner panel on its end opposite said end panel.

5. An automatic lock bottom carton having a pyramid closure comprising:

a generally tubular side wall including alternately hingedly connected opposed side panels and end panels;

a plurality of generally triangular bottom panels hingedly connected to the bottom edges of each of said side and end panels of said side wall;

said plurality of bottom panels each having a tab, the tabs of said bottom panels connected to a first opposed pair of panels having central openings with inner peripheries which receive and enclose projecting lock tabs on a second alternately disposed opposed pair of said bottom panels;

said second alternately disposed opposed pair of said bottom panels including second tabs for adhesive engagement with an adjacent one of said first opposed pair of panels.

6. The carton of claim 5 in which said second tabs are folded back upon their respective associated triangular bottom panel for adhesive engagement with the inside surface of the bottom panels having the tabs with central openings.

7. An automatic lock bottom carton having a pyramid closure comprising:

a generally tubular side wall including alternately hingedly connected opposed side panels and end panels;

a side panel liner panel hingedly connected to an end of one of said side wall panels, a center divider panel hingedly connected to said side panel liner panel at the end thereof opposite the end connected to said one of said side wall panels;

a plurality of generally triangular bottom panels hingedly connected to the bottom edges of said side wall, said side panel liner panel and said center divider panel;

said plurality of bottom panels each having a tab, the tabs of said bottom panels connected to said end panels and said center divider panel having central openings to receive projecting lock tabs on the bottom panels connected to said side panels and side liner panel; and, said center divider panel having a cutout hingedly attached to the bottom panel thereof for adhesive engagement with a tab of an adjacent triangular bottom panel.

8. The carton of claim 7 in which the center divider has a glue flap hingedly attached thereto on its side opposite said side panel liner panel for adhesive engagement with the side panel opposite said side panel liner panel.

* * * * *